US009115899B2

(12) United States Patent
Koizumi et al.

(10) Patent No.: US 9,115,899 B2
(45) Date of Patent: Aug. 25, 2015

(54) GAS TURBINE COMBUSTOR AND METHOD FOR OPERATING SAME

(71) Applicant: Hitachi, Ltd., Chiyoda-ku, Tokyo (JP)

(72) Inventors: Hiromi Koizumi, Hitachi (JP); Shohei Yoshida, Hitachiota (JP); Satoshi Dodo, Kasama (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 0 days.

(21) Appl. No.: 13/767,896

(22) Filed: Feb. 15, 2013

(65) Prior Publication Data

US 2013/0219903 A1 Aug. 29, 2013

(30) Foreign Application Priority Data

Feb. 28, 2012 (JP) ..... 2012-040866

(51) Int. Cl.

| | |
|---|---|
| ***F23R 3/28*** | (2006.01) |
| ***F23R 3/14*** | (2006.01) |
| ***F23C 7/00*** | (2006.01) |
| ***F23R 3/54*** | (2006.01) |

(52) U.S. Cl.

CPC ..... *F23R 3/286* (2013.01); *F23C 7/004* (2013.01); *F23R 3/14* (2013.01); *F23R 3/54* (2013.01); *F23C 2900/07001* (2013.01); *F23R 2900/00002* (2013.01)

(58) Field of Classification Search

CPC ..... F23R 3/32; F23R 3/12; F23R 3/14; F23R 3/286; F23C 7/004

USPC ..... 60/39.463, 737, 740, 742, 746–748; 239/399, 400, 402, 402.5, 404

See application file for complete search history.

(56) References Cited

U.S. PATENT DOCUMENTS

| | | | | |
|---|---|---|---|---|
| 3,630,024 | A * | 12/1971 | Hopkins | 60/742 |
| 4,890,453 | A * | 1/1990 | Iwai et al. | 60/39.465 |
| 4,993,222 | A * | 2/1991 | Iwai et al. | 60/776 |
| 5,259,182 | A | 11/1993 | Iwai et al. | |
| 7,143,583 | B2 * | 12/2006 | Hayashi et al. | 60/776 |
| 2005/0268618 | A1 | 12/2005 | Johnson et al. | |

(Continued)

FOREIGN PATENT DOCUMENTS

JP 5-86902 A 4/1993

OTHER PUBLICATIONS

Extended European Search Report dated Apr. 24, 2013 (five (5) pages).

*Primary Examiner* — Gerald L Sung
(74) *Attorney, Agent, or Firm* — Crowell & Moring LLP

(57) ABSTRACT

A gas turbine combustor stably burns low-BTU gases, such as blast furnace gases, that are heavily laden with $CO_2$. The gas turbine combustor includes a double-swirling burner with an inner swirler and an outer swirler, the burner having a configuration with gas fuel injection holes and air injection holes arranged at alternate positions in the inner swirler and with gas injection holes arranged in the outer swirler. In addition, fuel injection holes for enhancing flame stability are provided at positions radially inward of the inner swirler. An inner flame by the inner swirler and an outer flame by the outer swirler interact with each other to stably burn the low-BTU gas. In the inner swirler, the gas injection holes and air injection holes arranged at alternate positions contributes to raising a temperature of the inner flame to a level required for flame stabilization.

8 Claims, 6 Drawing Sheets

(56) References Cited

U.S. PATENT DOCUMENTS

2007/0227156 A1 10/2007 Saito et al.
2009/0173075 A1* 7/2009 Miura et al. ..... 60/737
2010/0281872 A1* 11/2010 Hadley et al. ..... 60/748
2013/0029277 A1* 1/2013 Koizumi et al. ..... 431/354

* cited by examiner

GAS TURBINE COMBUSTOR AND METHOD FOR OPERATING SAME

BACKGROUND OF THE INVENTION

1. Field of the Invention

The present invention relates generally to gas turbine combustors, and more particularly, to a structure of a burner in a gas turbine combustor constructed to achieve stable combustion of flame-retardant low-Btu gases.

2. Description of the Related Art

In general, fuels of lower heating values burn more slowly, since they are low in flame temperature and hence in burning velocity as well, compared with liquefied natural gas (LNG) which is a principal fuel of gas turbines. Another major feature of these fuels is their low levels of NOx emissions associated with combustion. Typical examples of these low-Btu gases include blast furnace gases. Blast furnace gases are off-gases stemming from blast furnaces in a steel production process, and needs for utilizing these gases as gas turbine fuels, are growing in recent years.

Blast furnace gases are flame-retardant gases that contain carbon monoxide (CO) and hydrogen ($H_2$) as their principal flammable gas, and are heavily laden with nitrogen ($N_2$) and carbon dioxide ($CO_2$) as well. These properties make it difficult to operate a gas turbine in its full load range by means only of a single blast-furnace gas as its fuel, from an ignition phase. To implement stable combustion of the blast-furnace gas in a partial load range of low combustion temperatures from the ignition phase, it is necessary to carburet the gas by mixing a hydrogen-containing coke oven gas or equivalent into the blast furnace gas, or to provide a liquid fuel or any other appropriate start-up fuel separately. In addition, since the stable combustion of flame-retardant gases is required, gas turbine combustors commonly employ a diffuse combustion scheme in which fuel and air are supplied from independent flow channels.

Meanwhile, a structural example of a low-Btu gas-fired burner is disclosed in JP-1993-86902-A. This burner employs a structure with a start-up fuel nozzle provided in a radially central section of the burner, gas injection holes arranged around the fuel nozzle, and gas injection holes and air injection holes further arranged at alternate positions around the former gas injection holes. The burner is targeted for a low-Btu gas heavily laden with $N_2$, such as a coal gasification syngas.

In general, in a burner using a swirling flow to stabilize a flame, a circulating gas region in which combustion gases circulate to impart heat to the fuel and air blasted from the burner needs to be formed in a neighborhood of its radially central section to stabilize the flame. The burner in JP-1993-86902-A actively utilizes a low-Btu gas to form the circulating gas region. This burner, which includes gas injection holes arranged only around an inner swirler, is constructed so that when a large portion of fuel is supplied to the inner swirler, a strong swirling flow is formed by utilizing a momentum of a large amount of low-Btu gas to enhance flame stability.

SUMMARY OF THE INVENTION

In the burner structure of JP-1993-86902-A, when a blast furnace gas is burnt, the flame formed near the burner (inner and outer swirlers) decreases in temperature because of a low $CO_2$ content relative to a $CO_2$ content in a coal gasification syngas. The decrease in the temperature of the flame around the inner swirler, in particular, leads to a flame temperature decrease in the circulating gas region, and to an ensuing flame temperature decrease around the outer swirler as well. These decreases in flame temperature have traditionally tended to cause sluggish combustion reactions, thus increasing CO emission levels at a combustor outlet. Additionally, during the combustion of the blast furnace gas, the Btu value of the gas stemming from the blast furnace has occasionally decreased to blow off the flame.

An object of the present invention is to provide a gas turbine combustor constructed to stably burn flame-retardant low-Btu gases, such as blast furnace gases, that are heavily laden with $CO_2$.

In accordance with an aspect of the present invention is provided a gas turbine combustor including: a combustion chamber for burning a fuel and air in a mixed condition; and a burner provided upstream in a gas flow direction of the combustor, for supplying the fuel and the air to inside of the combustion chamber and thus stabilizing a flame. The burner includes a first swirler, in which both of a plurality of gas injection holes for injecting the fuel, and a plurality of air injection holes for injecting air are arranged at alternate positions in a circumferential direction of the swirler, and a second swirler, which is provided at an outer periphery of the first swirler. Only a plurality of gas injection holes for injecting the fuel are arranged in the second swirler.

In accordance with the present invention, a gas turbine combustor constructed to stably burn flame-retardant low-Btu gases heavily laden with $CO_2$, such as blast furnace gases, can be supplied.

DESCRIPTION OF THE PREFERRED EMBODIMENTS

Figure 1:
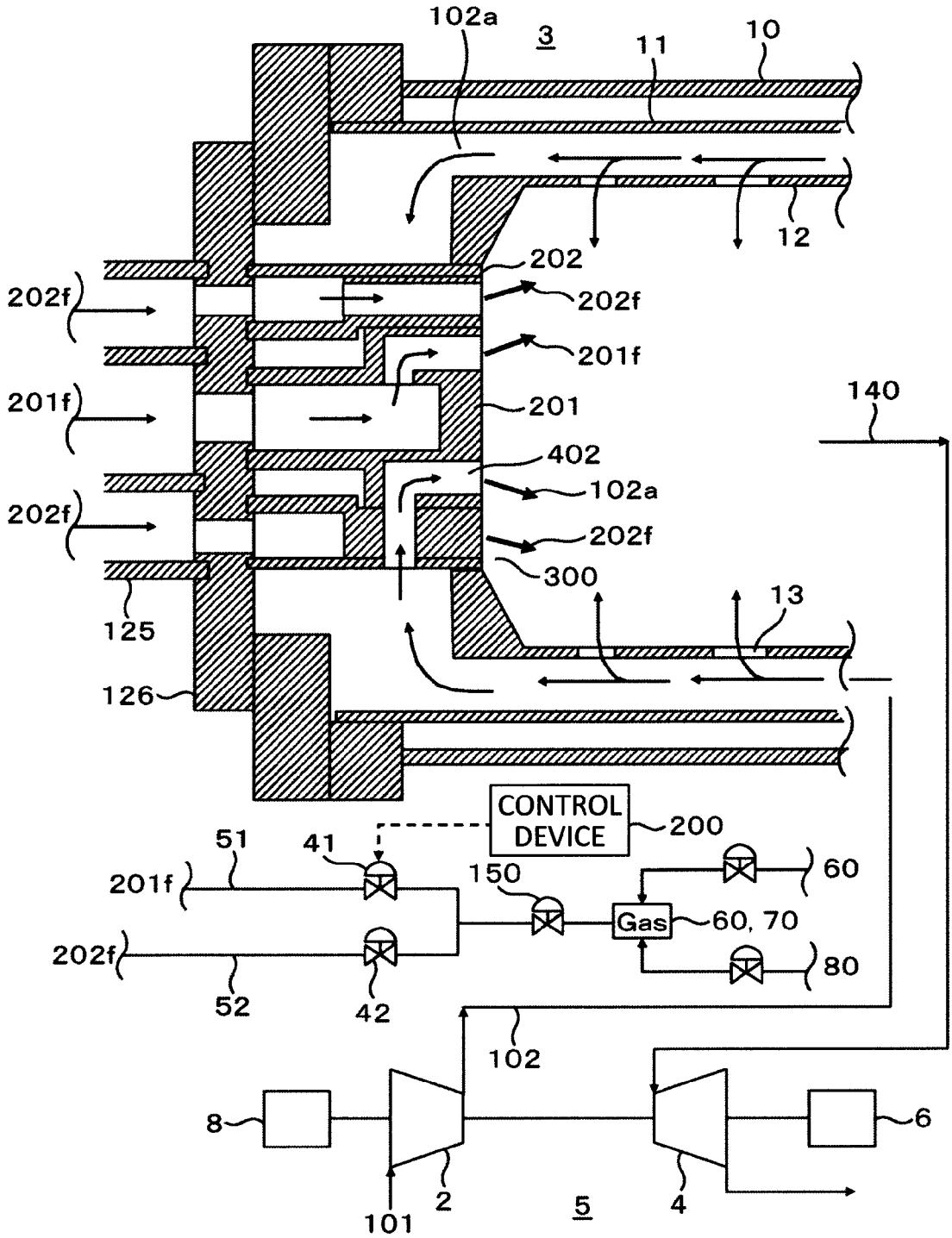
FIG. 1 is a combustor structural and system block diagram showing a first embodiment of the present invention.

Embodiments of the present invention that are described below relate to the structure of a burner in a gas turbine combustor constructed to stably burn flame-retardant low-Btu gases heavily laden with nitrogen ($N_2$) and carbon dioxide ($CO_2$), such as a blast furnace gas, coal gasification syngas, and biomass gasification syngas.

The kinds of low-Btu gases other than blast furnace gases include coal or biomass gasification syngases. Needs for utilizing these coal- or biomass-based gases as gas turbine fuels, are also increasing from the standpoint of more effective use of resources. Fuels obtained by mixing air into feedstock such as coal or wood chips and gasifying the feedstock, are low-Btu gases that contain $N_2$ in large amounts, and to burn these fuels, a burner capable of burning a start-up fuel and a low-Btu gas is required.

In general, fuels of lower heating values burn more slowly, since they are low in flame temperature and hence in burning velocity as well, compared with LNG and other high-Btu gases. A technique for achieving the stable combustion of a low-Btu gas is therefore an important factor for a gas turbine combustor. In addition, since these fuels have low heating values, obtaining a combustion gas temperature as high as those of LNG or other gases of higher heating values requires increasing a flow rate of the fuel supplied to the combustor. For this reason, combustors fired with a low-Btu gas are also characterized in that the fuel supplied to the combustor increases in flow rate.

As mentioned earlier, the structure outlined in JP-1993-86902-A exists as a structural example of a low-Btu gas-fired burner. In this structural example, a start-up fuel nozzle is provided in a radially central section of the burner, gas injection holes are arranged around the fuel nozzle, and gas injection holes and air injection holes are further arranged at alternate positions around the former gas injection holes.

In the above structure, which includes only gas injection holes arranged around an inner swirler, supply of a large portion of fuel to an inner swirler forms a strong swirling flow by utilizing a momentum of a large amount of low-Btu gas. In a neighborhood of a radially central section of the burner, a circulating gas region in which combustion gases circulate to impart heat to the fuel and air blasted from the burner is formed to enhance flame stability.

In this case, the fuel that has jetted from the inner swirler is inducted into the circulating gas region while being mixed with the air jetted from the outer swirler, so that stable combustion of a low-Btu gas can be obtained without a shortage of oxygen in that region. In addition, since the air to the swirlers is supplied from an outer periphery of the burner, it is structurally easy to provide air injection holes around the outer swirler, as in JP-1993-86902-A, and this characteristic yields advantages such as suppressing an increase in fabrication costs.

In the conventional burner structure as in JP-1993-86902-A, burning a blast furnace gas having a high $CO_2$ content relative to that of a coal gasification syngas reduces a temperature of a flame formed near the burner (inner and outer swirlers). The decrease in the temperature of the flame around the inner swirler, in particular, leads to a flame temperature decrease in the circulating gas region, and to an ensuing flame temperature decrease around the outer swirler as well. These decreases in flame temperature have traditionally tended to cause sluggish combustion reactions, thus increasing CO emission levels at a combustor outlet. Additionally, during the combustion of the blast furnace gas, which is an off-gas, the Btu value of the gas stemming from the blast furnace has occasionally decreased to blow off the flame.

To solve the above problems, the temperature of the flame formed near the inner swirler needs to be elevated for accelerated combustion reactions. To this end, it is crucial to provide gas injection holes and air injection holes in the inner swirler and mix the gas fuel with air for elevated flame temperature. The arrangement of the air injection holes in the inner swirler narrows an arrangement region for the gas injection holes and lowers a supply rate of the gas fuel, compared with the structure described in JP-1993-86902-A. For the combustion of a low-Btu gas heavily laden with $CO_2$, however, it is vital to elevate the flame temperature for accelerated combustion reactions.

Embodiments of the present invention that will be described hereunder, each relate to a double-swirling burner including an inner swirler and an outer swirler. This burner structurally has a basic configuration with gas injection holes and air injection holes arranged at alternate positions in the inner swirler, and with gas injection holes arranged in the outer swirler as well. Thus the flame formed near the inner swirler region has a higher temperature than in the conventional technique. Additionally, when fuel is supplied from the outer swirler, a flame originating from the inner flame will also be formed near the outer swirler and both flames will raise the flame temperature near the burner to enhance flame stability.

For these reasons, in the structure according to each embodiment of the present invention, when fuel is supplied from the outer swirler, the flame originating from the inner flame will also be formed near the outer swirler and both flames will raise the flame temperature near the burner to enhance flame stability, so the stable combustion of a blast furnace gas heavily laden with $CO_2$ is implemented.

First Embodiment

Hereunder, embodiments of the present invention will be described referring to the accompanying drawings.

(Combustor Configuration)

A block diagram of a gas turbine according to a first embodiment of the present invention, and an enlarged combustor cross-sectional view are shown in FIG. 1. The gas turbine 5 includes an air compressor 2, a combustor 3, a turbine 4, an electric generator 6, a start-up motor 8, and so on.

The compressor 2 generates combustion air 102 by drawing in air 101 from the atmosphere by suction and compressing the air 101. The gas turbine 5 supplies the combustion air 102 to the gas turbine combustor 3. In the combustor 3, the combustion air 102 that the compressor 2 has generated is mixed with a carbureted gas 70 (supplied in a partial load range from an ignition phase) that is a mixture of a low-Btu blast furnace gas 60 and a coke oven gas 80, and consequent combustion gases 140 are supplied to the turbine 4. The supplied combustion gases 140 give rotational motive power to the turbine 4, and the rotational motive power of the turbine 4 is transmitted to the compressor 2 and the generator 6. The rotational motive power that has been transmitted to the compressor 2 is used as motive power for compression, and the rotational motive power that has been transmitted to the generator 6 is converted into electrical energy.

The combustor 3 includes a combustion chamber 12 for burning a fuel and air in a mixed condition in an outer casing 10 that is a pressure vessel. The combustor 3 also includes a flow sleeve 11 for combustion chamber cooling, at an outer periphery of the combustion chamber 12. Additionally, a burner 300 for supplying the fuel and the air to the combustion chamber 12 and retaining a flame is disposed upstream in a gas flow direction of the combustion chamber 12. The combustion air 102 that has been supplied to the combustor 3 flows through a space present between the flow sleeve 11 and the combustion chamber 12, and then while cooling the combustion chamber 12, the combustion air 102 is supplied thereto from, for example, combustion air inlet holes 13 provided in a sidewall of the combustion chamber, and air injection holes 402 provided in the burner 300.

The burner 300 employs a double-swirling structure including an inner swirler 201 which is a first swirler, and an outer swirler 202 which is a second swirler provided at an outer periphery of the inner swirler 201. A flow rate and heating value of a low-Btu gas supplied to the inner swirler 201 and the outer swirler 202 can be varied according to particular load conditions of the gas turbine. In the partial load range from the ignition of the gas turbine, the carbureted gas 70 which is the mixture of the blast furnace gas 60 and the coke oven gas 80, is supplied. When an increase in a flow rate of the fuel increases a combustion temperature and thus raises the load, that is, under high-load conditions (e.g., in a full load range from an intermediate load state), only the blast furnace gas 60 can be supplied.

The low-Btu gas can have its supply pressure controllable with a pressure control valve 150 provided in a fuel line. A first fuel line 51 for supplying an inner fuel 201*f* to the inner swirler 201, and a second fuel line 52 for supplying an outer fuel 202*f* to the outer swirler 202 exist at a downstream side of the pressure control valve 150. The fuel lines 51 and 52 are fitted with a first fuel flow control valve 41 and a second fuel flow control valve 42, respectively, and flow rates of the fuel supplied to the first fuel line and the second fuel line can be controlled according to particular ignition and load conditions of the gas turbine, by a control device 200.

Burner Structure 1

Figure 2:
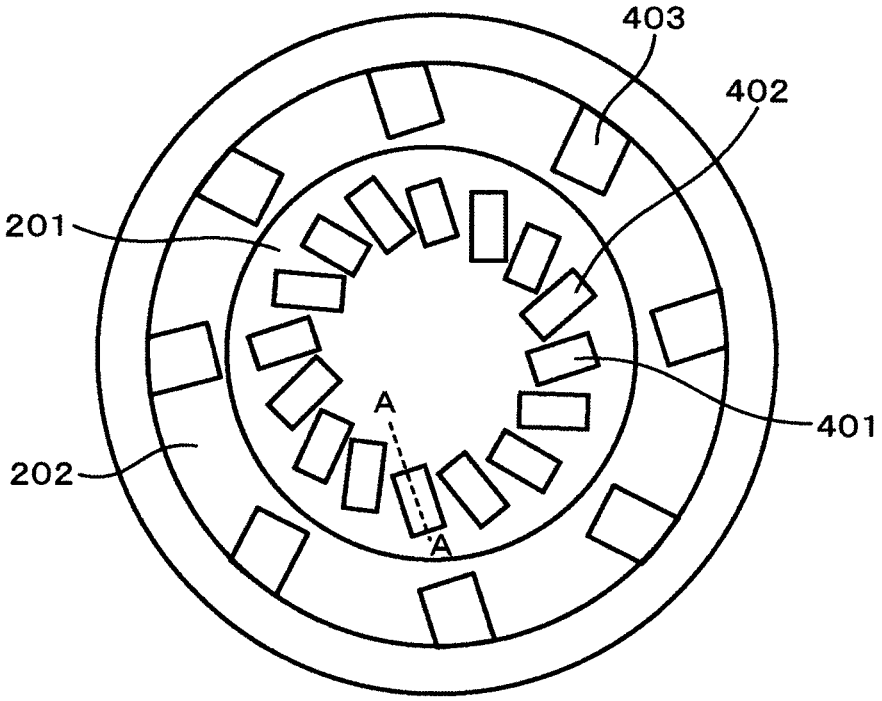
FIG. 2 is a front view of a burner, showing the first embodiment of the present invention.

FIG. 2 shows a front view of the burner 300. This view shows the burner 300 as seen from the downstream side. The burner according to the present invention has a double-swirling structure including the inner swirler 201 and the outer swirler 202. To elevate a flame temperature of the inner swirler even during combustion of a blast furnace gas containing a large amount of $CO_2$, gas injection holes 401 and air injection holes 402 are both arranged at alternate positions in a circumferential direction of the inner swirler 201, and only gas injection holes 403 are arranged in the outer swirler 202 existing outside the inner swirler 201.

Figure 3:
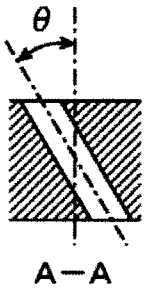
FIG. 3 is a cross-sectional view taken along line A-A in FIG. 2.

Each injection hole is provided with a swirl angle inclined in the circumferential direction, as shown in FIG. 3 (a cross-sectional view taken along line A-A in FIG. 2), and a low-velocity flame-stabilizing region is formed as a circulating gas region in a neighborhood of a radially central section of the burner, thereby enhancing combustion stability. In addition, since the plurality of gas injection holes 401 for injecting the fuel, and the plurality of air injection holes 402 for injecting air are arranged at alternate positions in the circumferential direction of the inner swirler 201, diffuse combustion that supplies the fuel and the air through independent flow channels ensures stable combustion of the low-Btu gas.

Meanwhile, as shown in FIG. 1, the gas fuel 202*f* is supplied from the gas injection holes 403 to the outer swirler 202. The gas fuel 202*f* is mixed with both of the air 102*a* supplied from the inner swirler 201, and the air supplied from the combustion air inlet holes 13 and existing near the burner, and when an inner flame is formed near the inner swirler 201, this flame induces an outer flame formed near the outer swirler. The formation of the outer flame elevates a temperature of the inner flame periphery, thus enhancing flame stability. This characteristic is particularly effective for combustion of low-Btu gases, such as blast furnace gases, that contain a large amount of $CO_2$.

Fuels having a high $CO_2$ content, as with blast furnace gases, are generally high in density, and when swirling flows are used to obtain flame stability as in the present invention, high-density fuels easily penetrate even to the outside because of their inertial force. In the combustor of the present embodiment, therefore, the fuel injection holes 401 and the air injection holes 402 are provided in the inner swirler 201 and the flow rate of the fuel is controlled so that, for example, a fuel-air mixing concentration matches stoichiometric mixing conditions, and thus so that the temperature of the flame formed near the inner swirler will be as high as possible to enable the stabilization of the inner flame. In other words, induction of air into the inner swirler accelerates the mixing between the air and part of the fuel prone to penetrate even to the outside, and hence stabilizes the inner flame to obtain flame stability. The characteristic that the fuel to be supplied to the burner is separately supplied to the inner swirler and the outer swirler each, suppresses an increase in fuel velocity, even when the flow rate of the fuel supplied to the burner increases. Accordingly, the penetration of the fuel to the outside is suppressed and the inner flame is further stabilized.

The combustor according to the present embodiment utilizes the stable inner flame to form an outer flame by mixing the fuel supplied from the outer swirler and the combustion air flowing in from a liner wall, and further exploits an interaction of the inner and outer flames to achieve the stable combustion of the flame-retardant low-Btu gas heavily laden with $CO_2$.

Figure 4:
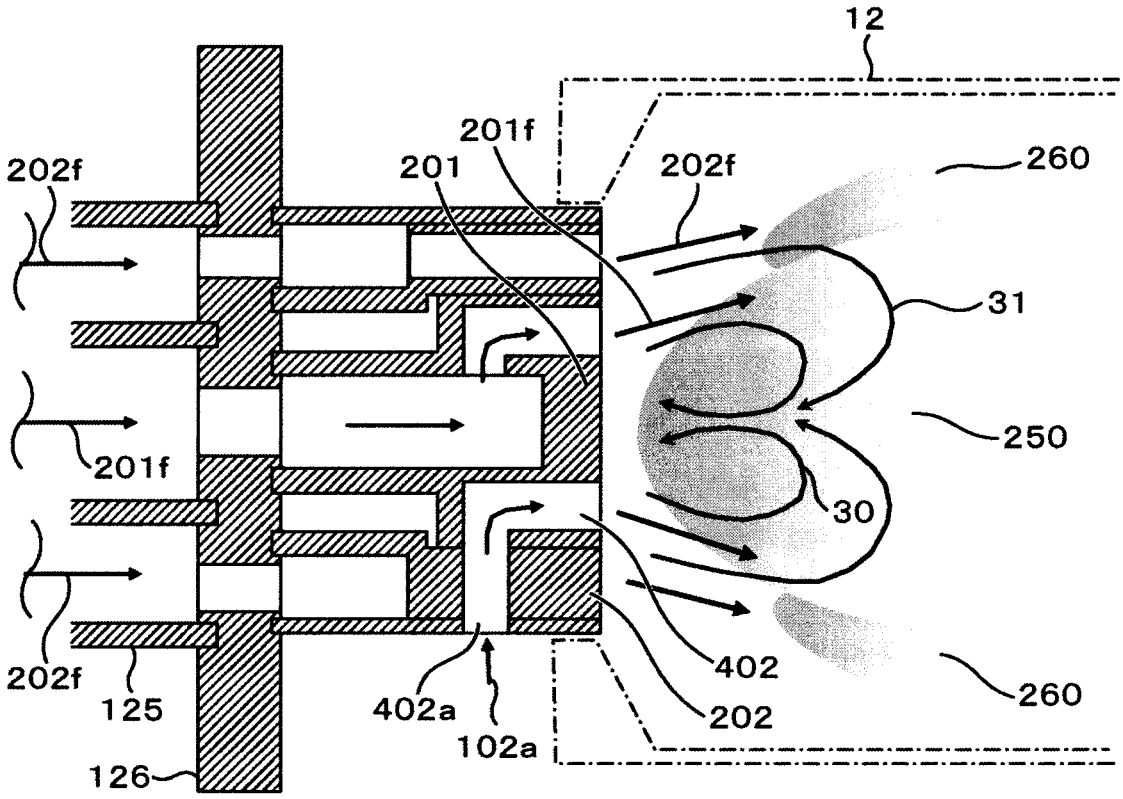
FIG. 4 is a cross-sectional view of the burner, showing the first embodiment of the present invention.

Next, a cross-sectional view of the burner 300 is shown in FIG. 4. The inner swirler 201 and the outer swirler 202 connect to a flange 126 that fixes a nozzle body (fuel lines) 125 provided to supply the gas fuels to the burner. The gas fuel 201*f* supplied to the inner swirler 201 is supplied through a fuel line provided centrally in the body 125, and the air 102*a* to the inner swirler 201 is supplied through an air inlet hole 402*a* provided in a side face of the outer swirler 202.

The gas fuel 201*f* and air 102*a* that have been supplied to the inner swirler 201 are both assigned a swirling component, whereby a negative pressure is generated in the radially central section of the burner and a circulating gas region 30 is formed. To continuously apply heat of the flame to the air 102*a* as well as to the gas fuel 201*f* supplied to the inner swirler 201, a flame 250 is continuously formed in the circulating gas region 30, so that flame stability is ensured.

Meanwhile, the gas fuel 202*f* to the outer swirler 202 is supplied from a fuel line provided outside the body 125. The gas fuel 202*f* that has been supplied to the outer swirler 202 is assigned a swirling component and a circulating gas region 31 is formed so as to surround the circulating gas region 30 that has been formed near the inner swirler 201. Heat is continuously applied from the inner flame 250 to the gas fuel 202*f*, thereby forming an outer flame 260.

Part of the combustion gases of the outer flame 260 is incorporated into the circulating gas region 30 via the circulating gas region 31, and flame stability is obtained by an interaction of the flames 250 and 260 formed by the inner swirler 201 and the outer swirler 202, respectively. In addition, since the gas fuel 202*f* is supplied from the outer swirler 202 in the present invention, a decrease in fuel concentration around the air injection holes 402 (radially outward of the burner) in the inner swirler 201 can be prevented and thus a region of a higher flame temperature can be expanded, which also contributes to flame stability.

In addition, if a flow rate ratio of fuel supply to the inner swirler and the outer swirler is previously set to match optimal conditions, stable combustion can be achieved, even when the flow of the fuel is controlled with one line. As shown and described in the present embodiment, however, providing the first fuel flow control valve 41 and the second fuel flow control valve 42 in the first fuel line 51 and the second fuel line 52, respectively, and configuring the combustor so that the control device 200 controls the flow rates of the fuel supplied to the first and second fuel lines, contributes to even more stable combustion since the fuel can be supplied at the optimal fuel flow rate ratio that match ignition and load conditions.

Figure 7:
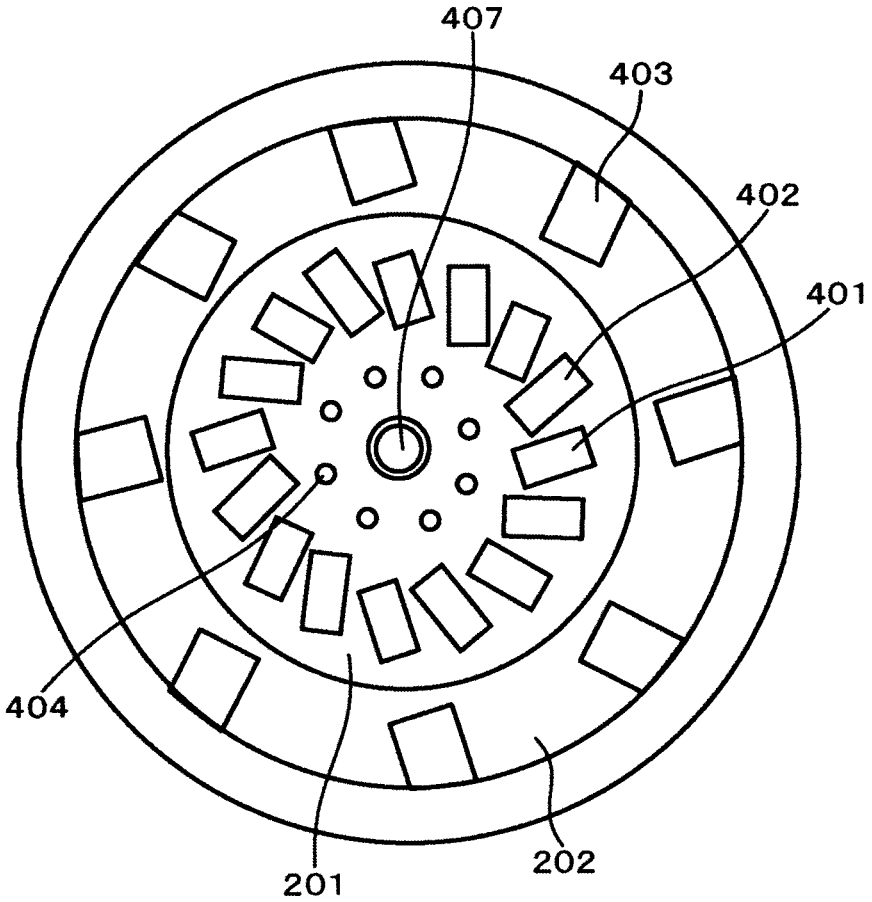
FIG. 7 is a front view of the burner provided with a fuel nozzle in the present invention.

Furthermore, while the present embodiment has been described assuming gas turbine ignition and load changes based upon a flow rate of the carbureted gas 70, stable combustion is also implemented when, as shown in FIG. 7, a liquid fuel nozzle 407 is disposed in the radially central section of the double-swirling burner. Moreover, although the gas injection holes and air injection holes shown in a rectangular form have been described, substantially the same advantageous effects can likewise be obtained by constructing the two types of injection holes in a circular form.

(Operating Method)

A method of operating the gas turbine combustor of the above-described burner structure is described below on the basis of FIG. 1. During start-up, the gas turbine is driven by such external motive power as of the start-up motor 8. When a rotating speed of the gas turbine is maintained at a speed commensurate with ignition conditions of the combustor, the combustion air 102 required for ignition is supplied to the combustor 3 and as a result, the ignition conditions hold. Under this state, when the carbureted gas 70 that has been created by mixing the coke oven gas 80 into the blast furnace gas 60 is supplied to the burner 300, ignition can be caused in the combustor 3. After the ignition of the combustor, the combustion gases 140 are supplied to the turbine 4 for increased flow rate of the carbureted gas 70. At the same time, the turbine 4 rotates at a higher speed and an ensuing release of driving by the start-up motor 8 places the gas turbine 4 in self-sustained operation, whereby the turbine reaches a no-load rated speed. After the turbine has reached the no-load rated speed, synchronous operation of the generator 6 is started and the flow rate of the carbureted gas 70 is increased. This raises an entrance gas temperature of the turbine 4, thus increasing the load. As a combustion gas temperature at the combustor exit increases with the increase in load, combustion stability also increases, which then makes it possible to turn off the coke oven gas that has been supplied for carbureting. In the burner, the interaction between the flame 250 formed by the inner swirler 201, and the flame 260 formed by the outer swirler 202, retains flame stability, even under single-gas combustion conditions based only upon the blast-furnace gas 60.

Second Embodiment

Burner Structure 2

Figure 5:
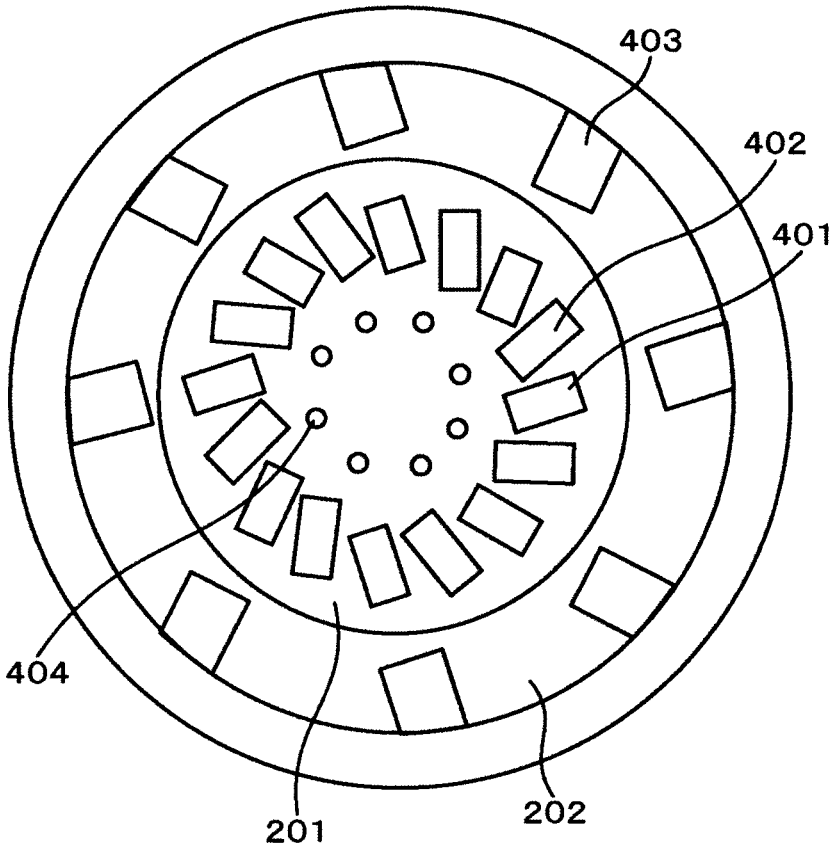
FIG. 5 is a front view of a burner, showing a second embodiment of the present invention.
Figure 6:
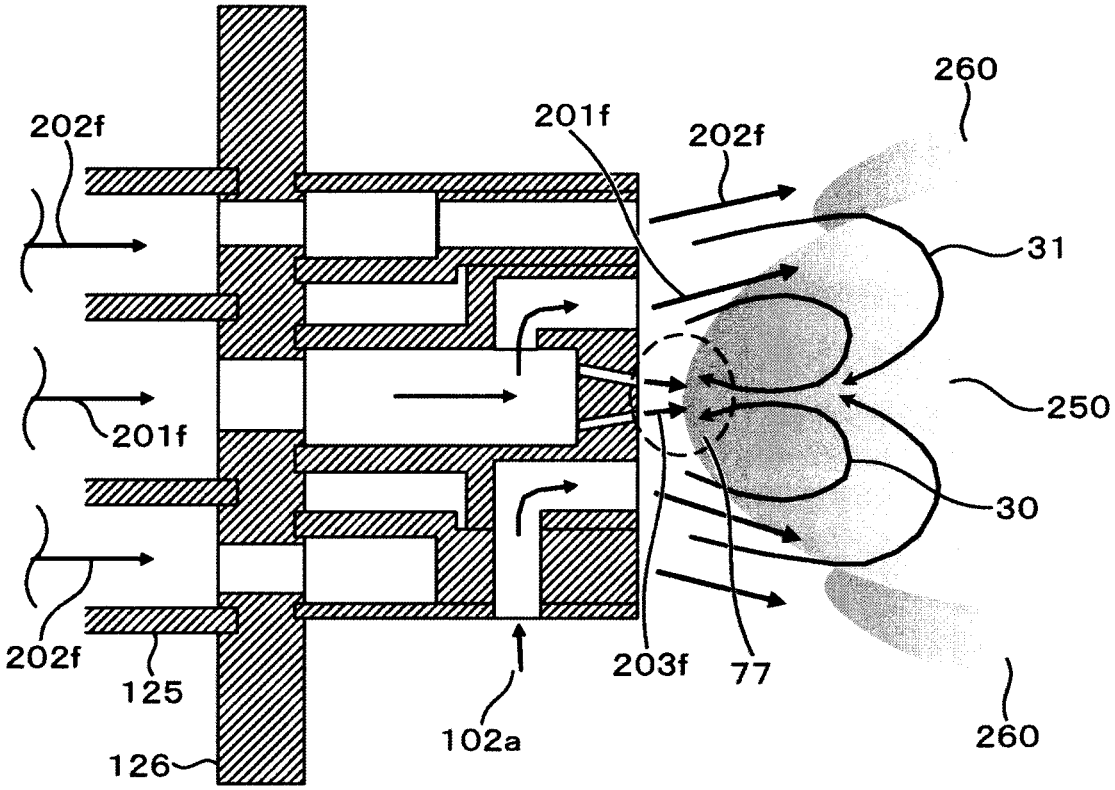
FIG. 6 is a cross-sectional view of the burner, showing the second embodiment of the present invention.

Burner structural views of a combustor which is a second embodiment of the present invention are shown in FIGS. 5 and 6. The present embodiment differs from the first embodiment in that fuel injection holes 404 for enhancing flame stability are provided more radially inward of the burner than gas injection holes 401 and air injection holes 402 arranged in an inner swirler 201. The fuel injection holes 404 for enhancing flame stability, provided more radially inward of the burner than the gas injection holes 401 and the air injection holes 402, are intended to prevent a decrease in fuel concentration inside a circulating gas region that the burner forms, by injecting fuel into a radially central neighborhood of the burner.

As described in the first embodiment, blast furnace gases heavily laden with $CO_2$ are of high densities, so that in the burner stabilizing a flame by swirling the fuel, the inertial force of these high-density fuel gases makes them easily penetrate even to the outside. This reduces the fuel concentration in the circulating gas region formed in the burner, resultingly lowers the flame temperature, and hence reduces combustion stability. The second embodiment of the present invention is intended to suppress these decreases.

A cross-sectional view of the burner in the combustor according to the second embodiment is shown in FIG. 6. The burner in the present embodiment is constructed so that a flame stability enhancing fuel 203*f* injected from the flame stability enhancing fuel injection holes 404 will work as a branch forming a part of an inner fuel 201*f* supplied to the inner swirler 201. The formation of this branch allows supply of the flame stability enhancing fuel 203*f* to be implemented in a simplified device arrangement and facilitates flow rate ratio control of the fuel and air injected from the inner swirler into the burner.

During single-gas turbine operation on a blast furnace gas 60 alone, a further decrease in heating value correspondingly increases a flow rate of the fuel to prevent gas turbine power from decreasing, and consequently increases a velocity at which the fuel is ejected from the swirler(s). If this increase in the ejection velocity of the gas fuel 201*f* occurs inside the inner swirler 201, the ejected gas fuel easily penetrates even to the outside, which in turn reduces the fuel concentration, and hence the flame temperature, within the circulating gas region 30. An ensuing decrease in outer flame temperature is likely to cause sluggish reactions, thus degrading combustion stability. In particular, the density of the gas containing a large amount of $CO_2$ in the fuel is high and in the present burner that uses a swirling flow to obtain flame stability, the gas fuel is prone to penetrate even to the outside and cause a temperature decrease in the circulating gas region 30.

The present embodiment, intended to suppress the temperature decrease in the circulating gas region 30, features supplying the flame stability enhancing fuel 203*f* to the circulating gas region 30 and preventing the fuel concentration from decreasing. During single-gas turbine operation on the blast furnace gas alone, therefore, even if the gas fuel decreases in heating value, the flame stability enhancing fuel 203*f* can be supplied to the circulating gas region 30 formed near the radially central section of the burner, and a resulting flame temperature rise near a flame stabilization point 77 enables stable combustion.

The flame stability enhancing fuel injection holes 404 in the present embodiment are also assigned an inclination angle at which each is inclined inward of the inner swirler 201 to inject the fuel in a radially inward direction thereof. This inclination of the fuel injection holes 404 concentrates the flame stability enhancing fuel 203*f* in the burner central section at which the circulating gas region 30 is formed, and provides a more significant favorable effect to improve combustion stability due to the flame temperature rise near the flame stabilization point 77.

In addition, for example, if the flame stability enhancing fuel injection holes, as with the gas injection holes 401 provided in the inner swirler 201, is assigned a swirl angle inclined in a circumferential direction of the inner swirler 201, this inclination aids in the formation of the circulating gas region 30 and thus further improves combustion stability.

Furthermore, as shown in FIG. 6, a liquid fuel nozzle 407 may be disposed in the radially central section of the double-swirling burner. This will implement even more stable combustion.

What is claimed is:

1. A gas turbine combustor comprising:

a combustion chamber for burning a fuel and air in a mixed condition; and a burner, provided upstream in a gas flow direction of the combustor, for supplying the fuel and the air to inside of the combustion chamber and thus stabilizing a flame;

wherein the burner includes a first swirler in which both of a plurality of gas injection holes for injecting the fuel, and a plurality of air injection holes for injecting air are arranged at alternate positions in a circumferential direction of the swirler, and a second swirler circumferentially surrounding an outer periphery of the first swirler, the second swirler being fitted only with a plurality of gas injection holes to inject the fuel, and wherein the plurality of gas injection holes and the plurality of air injection holes are independent flow channels that supply the fuel and the separately to the combustion chamber.

2. The gas turbine combustor according to claim 1, wherein:

a plurality of fuel injection holes for enhancing flame stability are arranged more radially inward of the burner than the gas injection holes and air injection holes arranged in the first swirler.

3. The gas turbine combustor according to claim 1, further comprising:

a first fuel flow control valve provided in a first fuel line which supplies the fuel to the first swirler;

a second fuel flow control valve provided in a second fuel line which supplies the fuel to the second swirler; and a control device that controls a flow rate of the fuel supplied to the first fuel line and the second fuel line according to the ignition or particular load conditions of the gas turbine.

4. The gas turbine combustor according to claim 2, wherein:

the fuel supplied to the flame stability enhancing fuel injection holes serves as a fluid branch forming a part of the fuel supplied to the first swirler.

5. The gas turbine combustor according to claim 2, wherein:

the flame stability enhancing fuel injection holes are assigned an inclination angle at which each of the fuel injection holes is inclined inward of the first swirler to inject the fuel in a radially inward direction thereof.

6. The gas turbine combustor according to claim 2, wherein:

the flame stability enhancing fuel injection holes are each assigned a swirl angle inclined in a circumferential direction of the first swirler.

7. A gas turbine combustor comprising:

a combustion chamber for burning a fuel and air in a mixed condition; and a burner, provided upstream in a gas flow direction of the combustor, for supplying the fuel and the air to inside of the combustion chamber and thus stabilizing a flame;

wherein the burner includes a first swirler in which both of a plurality of gas injection holes for injecting the fuel, and a plurality of air injection holes for injecting air are arranged at alternate positions in a circumferential direction of the swirler, and a second swirler provided at an outer periphery of the first swirler, the second swirler being fitted only with a plurality of gas injection holes to inject the fuel, wherein the plurality of gas injection holes and the plurality of air injection holes are independent flow channels that supply the fuel and the air separately to the combustion chamber, and wherein a fuel nozzle that injects a liquid fuel in an atomized condition is disposed in a radially central section of the first swirler.

8. A method for operating a gas turbine combustor which includes a combustion chamber for burning a fuel and air in a mixed condition, and a burner, provided upstream in a gas flow direction of the combustor, for supplying the fuel and the air to inside of the combustion chamber and thus stabilizing a flame, the burner including a first swirler in which both of a plurality of gas injection holes for injecting the fuel and a plurality of air injection holes for injecting air are arranged at alternate positions in a circumferential direction of the swirler, and a second swirler circumferentially surrounding an outer periphery of the first swirler, the second swirler being fitted only with a plurality of gas injection holes to inject the fuel, the method comprising:

supplying the fuel and the air separately from the plurality of gas injection holes and the plurality of air injection holes to the combustion chamber, after the fuel injected from the first swirler has been controlled in flow rate so that the flow rate of the fuel and that of air injected from the first swirler approach a predetermined stoichiometric mixing ratio, burning the fuel and the air to form an inner flame, and then burning the fuel injected from the second swirler circumferentially surrounding the outer periphery of the first swirler by utilizing heat of the inner flame to form an outer flame.

* * * * *